US010123637B1

(12) United States Patent
DeSena et al.

(10) Patent No.: US 10,123,637 B1
(45) Date of Patent: Nov. 13, 2018

(54) ILLUMINATING MERCHANDISE DISPLAYED AT A DISPLAY AND DISPENSING APPARATUS

(71) Applicant: Henschel-Steinau, Inc., Allendale, NJ (US)

(72) Inventors: Michael D. DeSena, West Caldwell, NJ (US); Michael D. Luberto, River Vale, NJ (US); Getachew Kassa, West Orange, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 22 days.

(21) Appl. No.: 15/492,660

(22) Filed: Apr. 20, 2017

(51) Int. Cl.

| | |
|---|---|
| ***A47F 9/04*** | (2006.01) |
| ***A47F 1/12*** | (2006.01) |
| ***A47F 11/10*** | (2006.01) |
| ***A47F 5/00*** | (2006.01) |
| ***F21V 21/34*** | (2006.01) |
| ***G09F 7/22*** | (2006.01) |
| *F21Y 115/10* | (2016.01) |
| *F21W 131/405* | (2006.01) |
| *G09F 7/18* | (2006.01) |

(52) U.S. Cl.
CPC ..... *A47F 9/04* (2013.01); *A47F 1/12* (2013.01); *A47F 5/005* (2013.01); *A47F 5/0018* (2013.01); *A47F 11/10* (2013.01); *F21V 21/34* (2013.01); *G09F 7/22* (2013.01); *A47F 2009/041* (2013.01); *F21W 2131/405* (2013.01); *F21Y 2115/10* (2016.08); *G09F 2007/1856* (2013.01)

(58) Field of Classification Search
CPC .. A47F 9/04; A47F 1/12; A47F 5/0018; A47F 5/005; A47F 11/10; A47F 2009/041; F21V 21/34; G09F 7/22; G09F 2007/1856; F21W 2131/405
See application file for complete search history.

(56) References Cited

U.S. PATENT DOCUMENTS

| | | | | |
|---|---|---|---|---|
| 4,317,604 | A * | 3/1982 | Krakauer | G07F 11/54 312/125 |
| 6,276,810 | B1 | 8/2001 | Vosshenrich | |
| 7,600,887 | B2 | 10/2009 | Sherman | |
| 7,918,353 | B1 | 4/2011 | Luberto | |
| 9,022,637 | B2 | 5/2015 | Meyer et al. | |
| 9,275,361 | B2 | 3/2016 | Meyer | |
| 2005/0082450 | A1 | 4/2005 | Barrett et al. | |
| 2012/0230018 | A1 | 9/2012 | Wiemer et al. | |
| 2014/0062849 | A1 | 3/2014 | Kayser | |
| 2014/0201041 | A1 | 7/2014 | Meyer | |
| 2014/0201042 | A1 | 7/2014 | Meyer | |
| 2014/0268949 | A1 | 9/2014 | Kayser | |
| 2014/0321105 | A1 | 10/2014 | Meyer et al. | |

(Continued)

*Primary Examiner* — Alan Cariaso
(74) *Attorney, Agent, or Firm* — Arthur Jacob

(57) ABSTRACT

A light fixture is placed in an apparatus that displays and dispenses merchandise at a point-of-purchase located adjacent a display shelf. The apparatus includes a retainer plate that secures the apparatus to the display shelf. A light source is located in a receptacle having an arm that is extended beneath the retainer plate, between the retainer plate and the display shelf. A ridge on the arm extends upwardly into a groove in the retainer plate to lock the receptacle and, consequently, the light source in position to illuminate merchandise displayed along the display shelf.

16 Claims, 4 Drawing Sheets

(56) References Cited

U.S. PATENT DOCUMENTS

| | | | | |
|---|---|---|---|---|
| 2014/0365344 | A1 | 12/2014 | Meyer | |
| 2015/0108838 | A1 | 4/2015 | Pierce | |
| 2015/0110153 | A1 | 4/2015 | Hoblit et al. | |
| 2015/0146018 | A1 | 5/2015 | Kayser et al. | |
| 2015/0235577 | A1 | 8/2015 | Meyer et al. | |
| 2015/0317682 | A1 | 11/2015 | Kayser et al. | |
| 2016/0048798 | A1 | 2/2016 | Meyer et al. | |
| 2017/0172317 | A1* | 6/2017 | Hay | A47F 3/0408 |

* cited by examiner

ILLUMINATING MERCHANDISE DISPLAYED AT A DISPLAY AND DISPENSING APPARATUS

The present invention relates generally to the display and dispensing of merchandise at a point-of-purchase associated with a display shelf and pertains, more specifically, to a light fixture and method for illuminating the merchandise displayed on the display shelf.

It has become quite common to affix display and dispensing apparatus to store shelves and the like where purchasers may view and select items offered for sale. One such apparatus is described in U.S. Pat. No. 7,918,353, wherein there is disclosed apparatus in which serially arranged items of merchandise are placed on a track, maintained in a longitudinal row, between adjacent side dividers, and are moved along the track in a forward longitudinal direction, toward a point-of-purchase, by a pusher mechanism. The track and the dividers are mounted upon a retainer plate secured to the display shelf, rendering the apparatus conveniently installed and reliable in performance.

The present invention provides an adjunct to the above-described display and dispensing apparatus, namely, a light fixture readily fitted to a current display and dispensing apparatus for illuminating the merchandise offered for purchase. As such, the present invention attains several objects and advantages, some of which are summarized as follows: Provides effective illumination for assisting a purchaser in viewing and selecting an item of merchandise at a point-of-purchase; promotes the sale of items of merchandise through an aesthetically enhanced display at a point-of-purchase; enables ease of installation to establish advantageous illumination of merchandise items presented at a display and dispensing apparatus; improves the presentation of merchandise at a point-of-purchase provided by a display and dispensing apparatus; makes use of structural features of an existing merchandise display and dispensing apparatus to simplify the addition of highly desirable illumination of items of merchandise offered for purchase; provides an economical, appealing adjunct to an existing merchandise display and dispensing apparatus; establishes long-term, effective and reliable illumination of merchandise items offered for sale at a point-of-purchase provided by a display and dispensing apparatus.

The above objects and advantages, as well as further objects and advantages, are attained by the present invention which may be described briefly as a light fixture for placement in an apparatus that displays and dispenses merchandise at a point-of-purchase located adjacent a display shelf having a shelf surface extending in lateral directions and a dispensing location placed at the point-of-purchase, wherein at least one of a divider and a merchandise-bearing track is to be extended along the shelf surface in a longitudinal direction away from the dispensing location, a retainer plate is to be affixed to the display shelf with the retainer plate extending along the lateral directions adjacent the point-of-purchase, and a securing arrangement is to attach the one of the divider and the merchandise-bearing track at a selected lateral location along the display shelf, the light fixture comprising: an elongate receptacle having a channel for receiving a light source, the channel extending along a lateral length of the receptacle; an arm extending from the receptacle in a transverse direction for intercepting the retainer plate; a connecting arrangement for connecting together the arm and the retainer plate, with the receptacle in a particular position wherein the channel of the receptacle extends along lateral directions in confrontation with the one of the divider and the merchandise-bearing track such that upon placement of the light source within the channel, the light source is positioned to illuminate merchandise displayed along the display shelf.

In addition, the present invention provides a method for placing a light fixture in an apparatus that displays and dispenses merchandise at a point-of-purchase located adjacent a display shelf having a shelf surface extending in lateral directions and a dispensing location placed at the point-of-purchase, wherein at least one of a divider and a merchandise-bearing track is to be extended along the shelf surface in a longitudinal direction away from the dispensing location, a retainer plate is to be affixed to the display shelf with the retainer plate extending along the lateral directions adjacent the point-of-purchase, and a securing arrangement is to attach the one of the divider and the merchandise-bearing track at a selected lateral location along the display shelf, the method comprising: providing an elongate receptacle having a channel for receiving a light source, the channel extending along a lateral length of the receptacle; extending an arm from the receptacle in a transverse direction; intercepting the retainer plate with the arm; and connecting together the aim and the retainer plate, with the receptacle in a particular position wherein the channel of the receptacle is extended along lateral directions in confrontation with the one of the divider and the merchandise-bearing track such that upon placement of the light source within the channel, the light source is positioned to illuminate merchandise displayed along the display shelf.

The present invention will be understood more completely, while still further objects and advantages will become apparent, in the following detailed description of preferred embodiments of the invention illustrated in the accompanying drawing, in which.

Figure 1:
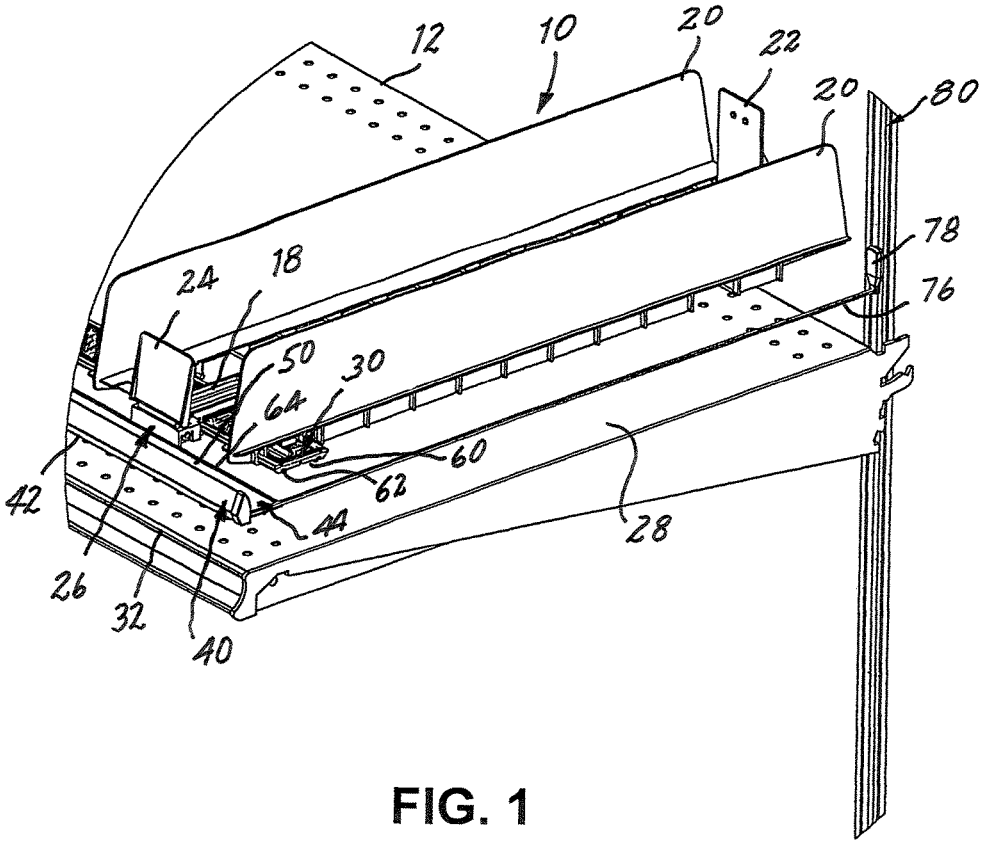
FIG. 1 is an exploded pictorial view showing a light fixture constructed in accordance with the present invention being installed in connection with a merchandise display and dispensing apparatus, in accordance with the present invention.
Figure 2:
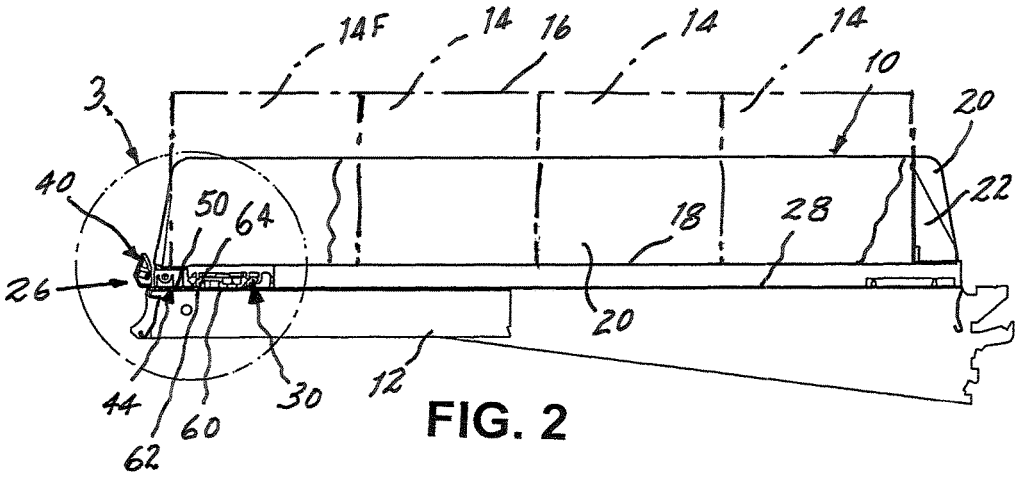
FIG. 2 is a side elevational view of the light fixture installed adjacent a point-of-purchase provided by the display and dispensing apparatus.
Figure 3:
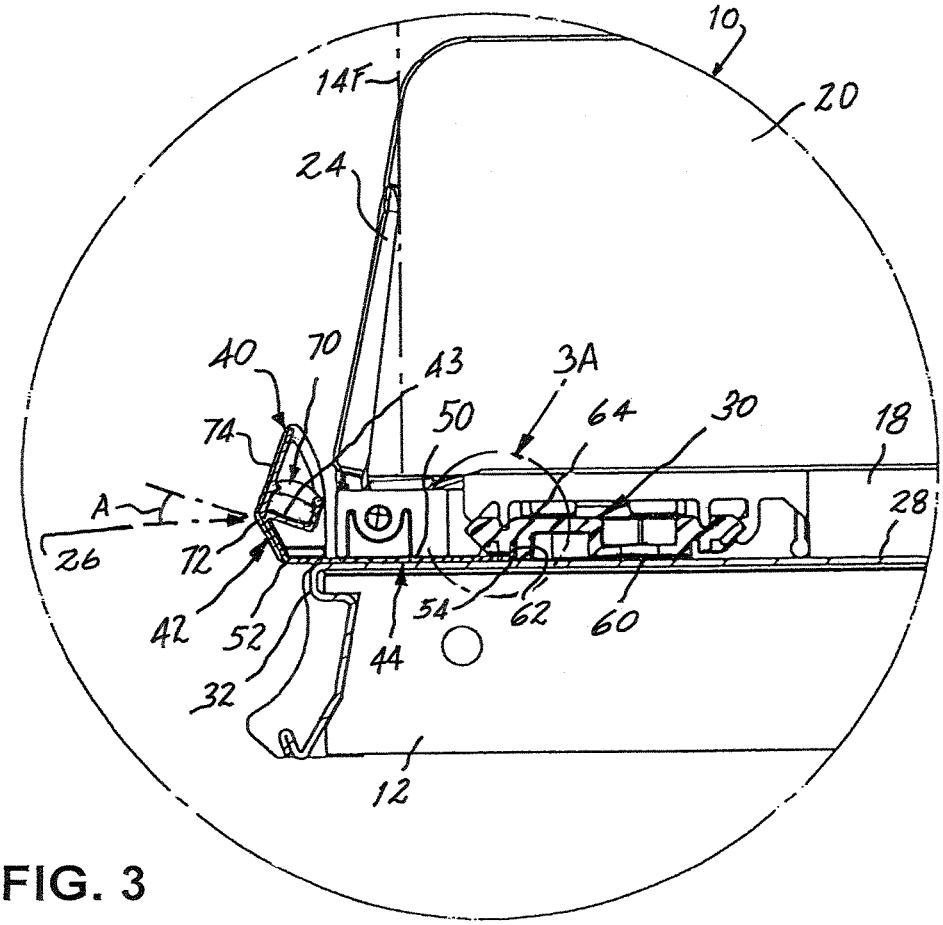
FIG. 3 is an enlarged fragmentary view of a portion of FIG. 2 designated by arrow 3 in FIG. 2.
Figure 3A:
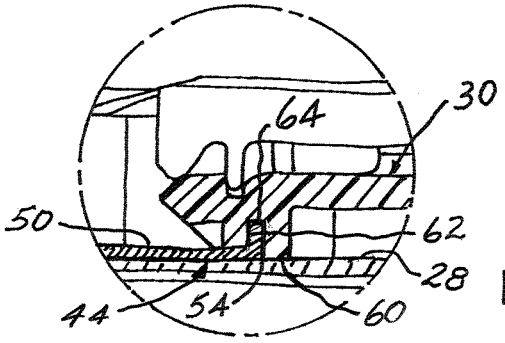
FIG. 3A is a further enlarged fragmentary view of a portion of FIG. 3 designated by arrow 3A in FIG. 3.

Referring now to the drawing, and especially to FIGS. 1 through 3A thereof, a display and dispensing apparatus is shown at 10 and is seen, in FIG. 1, being installed on a display shelf 12 for displaying and dispensing items of merchandise shown in phantom at 14 in FIG. 2 wherein items 14 are aligned in a row 16 along a track 18 with the items 14 maintained in row 16 by dividers 20, while being advanced in a longitudinally forward direction by a pusher mechanism 22 toward a gate 24 adjacent a point-of-purchase 26. Track 18 and dividers 20 are secured in place at respective selected lateral locations along surface 28 of shelf 12 by attachment to a retainer plate 30 affixed to shelf 12, adjacent forward edge 32 of shelf 12, all in a now-conventional manner such as that described in U.S. Pat. No. 7,918,353, the full disclosure of which is incorporated herein by reference thereto.

The present invention provides for the effective and aesthetic illumination of at least the forward-most merchandise item 14F, located at the point-of-purchase 26. To that end, a light fixture 40 is provided for juxtaposition with the forward edge 32 of shelf 12 to extend laterally along the shelf 12. Light fixture 40 includes an elongate receptacle 42 having a channel 43 extending all along the lateral length of the receptacle 42. An arm 44 extends from the receptacle 42 in a transverse direction for intercepting the retainer plate 30. A connecting arrangement is provided for connecting together the arm 44 and the retainer plate 30, with the receptacle 42 placed in a particular position wherein the channel 44 extends along the lateral directions in confrontation with track 18 and dividers 20 and, consequently, in juxtaposition with point-of-purchase 26.

Arm 44 is in the form of a flat member 50 integrated with receptacle 42 along a forward edge 52 and extending in a rearward longitudinal direction from receptacle 42 to a rearward edge 54, enabling arm 44 to be placed beneath retainer plate 30 so as to be captured between retainer plate 30 and shelf surface 28, thereby securing arm 44 and, consequently, receptacle 42 to shelf 12. Retainer plate 30 includes a basal surface 60 which confronts the shelf surface 28 and a recess in the form of a groove 62 extending upwardly from basal surface 60, laterally along the retainer plate 30. Arm 44 includes a projection in the form of a ridge 64 extending upwardly from flat member 50 laterally along the arm 44. Ridge 64 is complementary to groove 62 such that upon placement of arm 44 between retainer plate 30 and shelf surface 28, ridge 64 will enter groove 62 to lock arm 44 and, consequently, receptacle 42 against movement relative to retainer plate 30 as light fixture 40 is secured in place between retainer plate 30 and shelf 12.

A light source, preferably in the form of an LED array 70, is seated within channel 43 and, in the illustrated preferred embodiment, receptacle 42 is canted at an angle A relative to arm 44 to aim illumination more toward item 14F. Receptacle 42 includes a forward wall 72, and a shield 74 extends upwardly from forward wall 72 to mask LED array 70 from view from forward of the receptacle 42 while reflecting light toward item 14F. Power is delivered to LED array 70 via an electrical conductor 76 connected by a suitable electrical connector 78 to a power strip 80 mounted behind the shelf 12. In this manner light fixture 40 establishes effective illumination of merchandise items 14 for assisting a purchaser (not shown) in viewing and selecting an item 14 presented at a point-of-purchase 26 while promoting purchases through enhanced aesthetic appeal.

In the preferred construction, receptacle 42 and arm 44 are elements of a unitary structure in the form of an extrusion. While alternate materials are available, the preferred material is aluminum.

Figure 4:
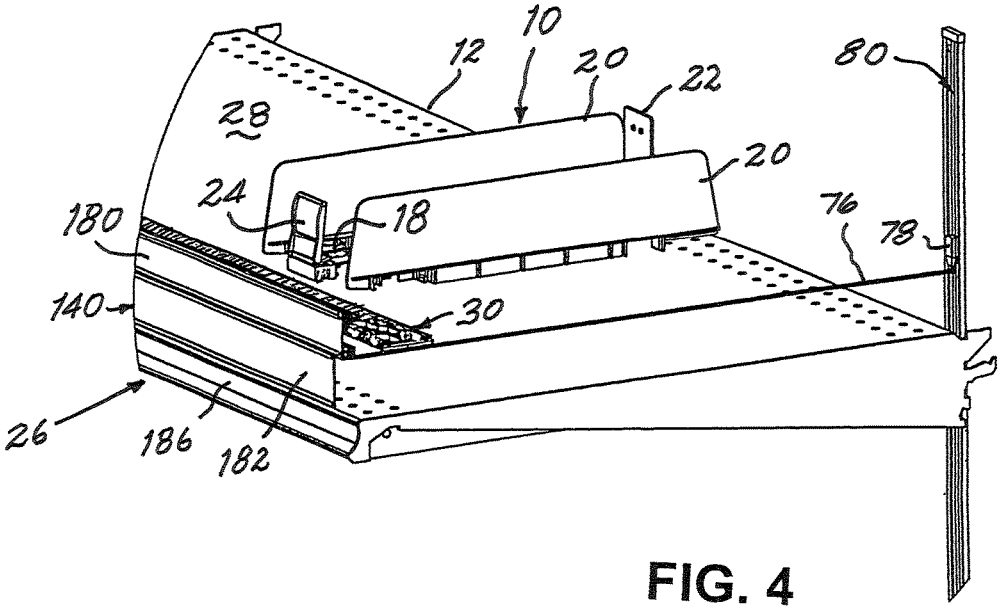
FIG. 4 is an exploded pictorial view showing another light fixture constructed in accordance with the present invention and being installed in connection with a merchandise display and dispensing apparatus, in accordance with the present invention.
Figure 5:
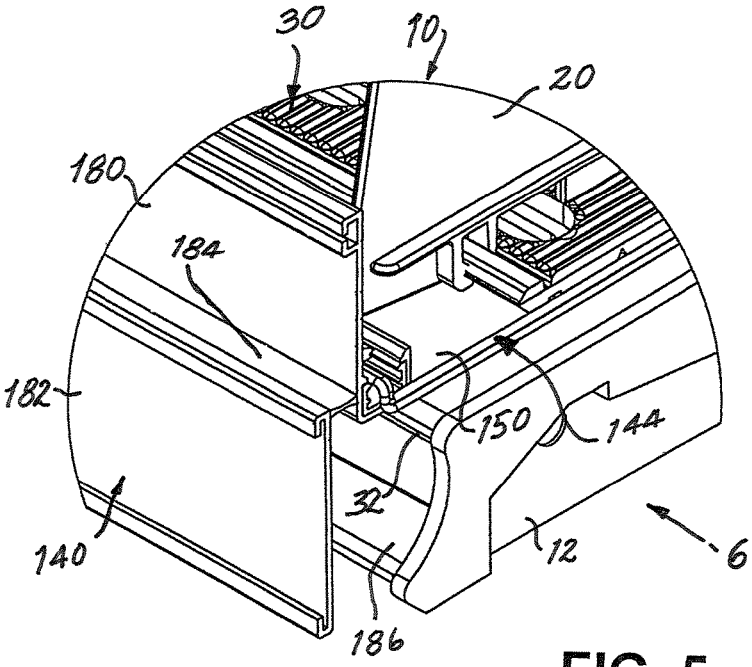
FIG. 5 is an enlarged fragmentary pictorial view showing the light fixture and the display and dispensing apparatus installed on a shelf.
Figure 6:
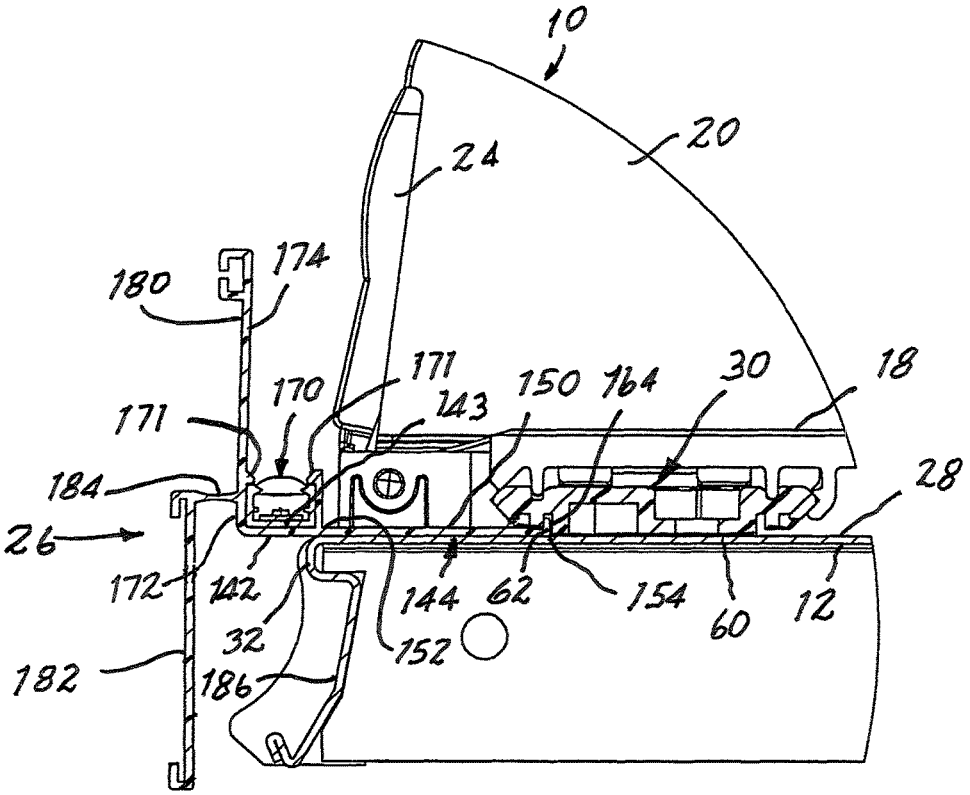
FIG. 6 is an enlarged elevational view taken in the direction of arrow 6 in FIG. 5.

Turning now to FIGS. 4 through 6, wherein components common to those described in connection with FIGS. 1 through 3A are labeled with the same reference characters, another embodiment of the present invention is illustrated in the form of light fixture 140 provided for juxtaposition with forward edge 32 of shelf 12 to extend laterally along shelf 12. Light fixture 140 includes an elongate receptacle 142 having a channel 143 extending all along the lateral length of the receptacle 142. An arm 144 extends from the receptacle 142 in a transverse direction for intercepting retainer plate 30. A connecting arrangement is provided for connecting together arm 144 and retainer plate 30, with the receptacle 142 placed in a particular position wherein the channel 143 extends along the lateral directions in confrontation with track 18 and dividers 20 and, consequently, in juxtaposition with point-of-purchase 26.

Arm 144 is in the form of a flat member 150 integrated with receptacle 142 along a forward edge 152 and extending in a rearward longitudinal direction from receptacle 142 to a rearward edge 154 enabling arm 144 to be placed beneath retainer plate 30 so as to be captured between retainer plate 30 and shelf surface 28, thereby securing arm 144 and, consequently, receptacle 142 to shelf 12. Arm 144 includes a projection in the form of a ridge 164 extending upwardly from flat member 150, laterally along the arm 144. Ridge 164 is complementary to groove 62 within retainer plate 30 such that upon placement of arm 144 between retainer plate 30 and shelf surface 28, ridge 164 will enter groove 62 to lock arm 144 and, consequently, receptacle 142 against movement relative to retainer plate 30 as light fixture 140 is secured in place between retainer plate 30 and shelf 12.

A light source, preferably in the form of an LED array 170, is seated within channel 143 and, in the present embodiment, is secured within channel 143 by retaining ledges 171. Receptacle 142 includes a forward wall 172, and a shield 174 extends upwardly from forward wall 172 to mask LED array 170 from view from forward of the receptacle 142. Thus, illumination is directed upwardly and toward merchandise items 14 while shielded from being directed toward a purchaser (not shown). Power is delivered to LED array 170 via electrical conductor 76 connected by electrical connector 78 to power strip 80 mounted behind shelf 12.

For added convenience, light fixture 140 includes an information display strip 180 projecting upwardly from forward wall 172 to receive and display supplemental information pertaining to the merchandise being displayed and dispensed at shelf 12. In addition, a graphic strip 182 depends downwardly from forward wall 172 to receive aesthetically appealing graphics, perhaps related to the merchandise displayed on shelf 12. A hinge 184 is interposed between graphic strip 182 and forward wall 172 for enabling selective raising of the graphic strip 182 to reveal basic information, such as a UPC code, carried by a conventional price channel 186 placed on the shelf 12 behind the graphic strip 182.

In the preferred construction, receptacle 142, arm 144, forward wall 172, information display strip 180 and graphic strip 182 are elements of a unitary structure in the form of an extrusion. While alternate materials are available, the preferred material is a synthetic polymeric material, in which case hinge 184 is constructed in the form of a "living" hinge.

It will be seen that the present invention attains all of the objects and advantages summarized above, namely: Provides effective illumination for assisting a purchaser in viewing and selecting an item of merchandise at a point-of-purchase; promotes the sale of items of merchandise through an aesthetically enhanced display at a point-of-purchase; enables ease of installation to establish advantageous illumination of merchandise items presented at a display and dispensing apparatus; improves the presentation of merchandise at a point-of-purchase provided by a display and dispensing apparatus; makes use of structural features of an existing merchandise display and dispensing apparatus to simplify the addition of highly desirable illumination of items of merchandise offered for purchase; provides an economical, appealing adjunct to an existing merchandise display and dispensing apparatus; establishes long-term, effective and reliable illumination of merchandise items offered for sale at a point-of-purchase provided by a display and dispensing apparatus.

it is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A light fixture for placement in an apparatus that displays and dispenses merchandise at a point-of-purchase located adjacent a display shelf having a shelf surface extending in lateral directions and a dispensing location placed at the point-of-purchase, wherein at least one of a divider and a merchandise-bearing track is to be extended along the shelf surface in a longitudinal direction away from the dispensing location, a retainer plate is to be affixed to the display shelf with the retainer plate extending along the lateral directions adjacent the point-of-purchase, and a securing arrangement is to attach the one of the divider and the merchandise-bearing track at a selected lateral location along the display shelf, the light fixture comprising:

an elongate receptacle having a channel for receiving a light source, the channel extending along a lateral length of the receptacle;

an arm extending from the receptacle in a transverse direction for intercepting the retainer plate;

a connecting arrangement for connecting together the arm and the retainer plate, with the receptacle in a particular position wherein the channel of the receptacle extends along lateral directions in confrontation with the one of the divider and the merchandise-bearing track such that upon placement of the light source within the channel, the light source is positioned to illuminate merchandise displayed along the display shelf.

2. The light fixture of claim 1 wherein the arm is located to extend beneath the retainer plate for capture between the retainer plate and the shelf surface, the arm including a projection for engaging the retainer plate to secure the arm and, consequently, the receptacle in the particular position.

3. The light fixture of claim 2 wherein the retainer plate includes a basal surface for confronting the shelf surface, and a recess extending upwardly from the basal surface, the projection extending upwardly from the arm such that upon placement of the arm beneath the retainer plate, the projection will extend into the recess to preclude movement of the arm in longitudinal directions relative to the retainer plate.

4. The light fixture of claim 3 wherein the recess comprises a groove extending laterally along the retainer plate, the arm comprises a flat member extending laterally along the receptacle, and the projection comprises a ridge complementary to the groove and extending laterally along the flat member for projecting upwardly into the groove to lock the light fixture in place in the apparatus.

5. The light fixture of claim 4 wherein the arm includes a forward edge and a rearward edge spaced longitudinally from the forward edge, and the receptacle extends along the forward edge.

6. The light fixture of claim 5 wherein the receptacle is canted relative to the arm, in a direction for aiming the light source toward the merchandise displayed along the display shelf.

7. The light fixture of claim 5 wherein the ridge extends in lateral directions along the rearward edge.

8. The light fixture of claim 5 wherein the receptacle, the arm and the ridge comprise a unitary construction.

9. The light fixture of claim 5 wherein the receptacle includes a forward wall, and a shield extending upwardly from the forward wall to mask the light source from view from forward of the receptacle.

10. The light fixture of claim 5 wherein the receptacle includes a forward wall and an information display strip projecting upwardly from the forward wall to receive and display supplemental information pertaining to the merchandise displayed on the display shelf.

11. The light fixture of claim 5 wherein the receptacle includes a forward wall and a graphic strip depending downwardly from the forward wall to receive graphics related to the merchandise displayed on the display shelf.

12. The light fixture of claim 11 including a hinge between the graphic strip and the forward wall, the hinge being placed for enabling selective raising of the graphic strip to reveal information placed on the display shelf behind the graphic strip.

13. A method for placing a light fixture in an apparatus that displays and dispenses merchandise at a point-of-purchase located adjacent a display shelf having a shelf surface extending in lateral directions and a dispensing location placed at the point-of-purchase, wherein at least one of a divider and a merchandise-bearing track is to be extended along the shelf surface in a longitudinal direction away from the dispensing location, a retainer plate is to be affixed to the display shelf with the retainer plate extending along the lateral directions adjacent the point-of-purchase, and a securing arrangement is to attach the one of the divider and the merchandise-bearing track at a selected lateral location along the display shelf, the method comprising:

providing an elongate receptacle having a channel for receiving a light source, the channel extending along a lateral length of the receptacle;

extending an arm from the receptacle in a transverse direction;

intercepting the retainer plate with the arm; and connecting together the arm and the retainer plate, with the receptacle in a particular position wherein the channel of the receptacle is extended along lateral directions in confrontation with the one of the divider and the merchandise-bearing track such that upon placement of the light source within the channel, the light source is positioned to illuminate merchandise displayed along the display shelf.

14. The method of claim 13 including:

locating the arm to extend beneath the retainer plate;

capturing the arm between the retainer plate and the shelf surface;

providing a projection on the arm; and engaging the projection with the retainer plate to secure the arm and, consequently, the receptacle in the particular position.

15. The method of claim 14 including:

providing the retainer plate with a basal surface and a recess extending upwardly from the basal surface;

confronting the basal surface with the shelf surface;

extending the projection upwardly from the arm such that upon placement of the arm beneath the retainer plate, the projection is extended into the recess to preclude movement of the arm in longitudinal directions relative to the retainer plate.

16. The method of claim 15 including extending the recess and the projection in lateral directions to lock the light fixture in place in the apparatus.

* * * * *